US005614037A

United States Patent [19]

Keener

[11] Patent Number: 5,614,037

[45] Date of Patent: Mar. 25, 1997

[54] METHOD FOR PREPARING PRE-COATED ALUMINUM ARTICLES AND ARTICLES PREPARED THEREBY

[75] Inventor: Steven G. Keener, Trabuco Canyon, Calif.

[73] Assignee: McDonnell Douglas Corporation, Long Beach, Calif.

[21] Appl. No.: 432,223

[22] Filed: May 1, 1995

[51] Int. Cl.[6] ..... C23F 17/00

[52] U.S. Cl. ..... 148/537; 148/698; 148/699; 148/700; 427/388.1

[58] Field of Search ..... 148/537, 698–702; 427/388.1

[56] References Cited

U.S. PATENT DOCUMENTS 3,032,448 5/1962 Siebel ..... 148/537
3,123,516 3/1964 Eiland ..... 427/388.1
4,115,607 9/1978 Hasegawa ..... 148/537

OTHER PUBLICATIONS

SN 174,078, Alien Property Custodian, Durr May 11, 1943.
Anon, "Material Safety Data Sheet for Hi–Kote 1", 2 pages (Feb. 9, 1994).
Anon, "Material Safety Data Sheet for Alumazite ZY–138", 4 pages (27 Apr. 1993).

*Primary Examiner*—Sam Silverberg
*Attorney, Agent, or Firm*—Ronald Taylor

[57] ABSTRACT

An aluminum-alloy article such as a fastener is prepared by providing an aluminum-alloy article that is not in its final heat-treated state, and is preferably in its annealed state. A curable organic coating material is also provided. The method includes applying the organic coating material to the aluminum-alloy article, and heat-treating the coated aluminum article to its final heat-treated state, thereby simultaneously curing the organic coating.

11 Claims, 2 Drawing Sheets

METHOD FOR PREPARING PRE-COATED ALUMINUM ARTICLES AND ARTICLES PREPARED THEREBY

BACKGROUND OF THE INVENTION

This invention relates to the preparation of coated aluminum-alloy articles, and, more particularly, to the preparation of coated and heat-treated aluminum rivets.

Fasteners are used to mechanically join the various structural elements and subassemblies of aircraft. For example, a large transport aircraft typically includes over one million fasteners such as bolts, screws, and rivets. The fasteners are formed of strong alloys of metals such as titanium, steel, and aluminum alloys. In most cases, the fasteners are heat-treated, as by an aging treatment, to achieve as high a strength, in combination with other desirable properties, as is reasonably possible for that particular alloy. Heat-treating usually involves a sequence of one or more steps of controlled heating in a controlled atmosphere, maintenance at temperature for a period of time, and controlled cooling. These steps are selected for each particular material in order to achieve its desired physical and mechanical properties.

It has been the practice to coat some types of fasteners with organic coatings to protect the base metal of the fasteners against corrosion damage. In the usual approach, the fastener is first fabricated and then heat-treated to its required strength. After heat-treatment, the fastener is etched with a caustic soda bath to remove the scale produced in the heat-treatment. Optionally, the fastener is alodined or anodized. The coating material, dissolved in a volatile carrier liquid, is applied to the fastener by spraying, dipping, or the like. The carrier liquid is evaporated. The coated fastener is heated to elevated temperature for a period of time to cure the coating. The finished fastener is used in the fabrication of the structure.

This coating approach works well with fasteners made of a base metal having a high melting point, such as fasteners made of steel or titanium alloys. Such fasteners are heat-treated at temperatures well above the curing temperature of the coating. Consequently, the curing of the coating, conducted after heat-treating of the fastener is complete, does not adversely affect the properties of the already treated base metal.

On the other hand, aluminum alloys have a much lower melting point, and thence a generally much lower heat-treatment temperature, than steel and titanium alloys. It has not been the practice to coat high-strength aluminum-alloy fasteners with curable coatings, because it is observed that the curing treatment for the coating can adversely affect the strength of the fastener. The aluminum-alloy fasteners are therefore more susceptible to corrosion than would otherwise be the case. Additionally, the presence of the organic coating aids in the installation of the fastener for titanium alloys and steel. The absence of the coating means that aluminum fasteners such as rivets must be installed using a wet sealant compound for purposes of corrosion protection. The wet sealant compound is messy and difficult to work with, and may require extensive cleanup of the area around the fastener using caustic chemical solutions.

There exists a need for an improved approach to the protection of aluminum-based fasteners such as rivets. The present invention fulfills this need, and further provides related advantages.

SUMMARY OF THE INVENTION

The present invention provides a method for preparing an aluminum-alloy article such as a rivet. The article is heat-treated to high strength, and also is protected by a cured organic coating. The application of the coating does not adversely affect the properties of the article. The present approach is accomplished at an additional cost of much less than one cent per fastener above its unprotected cost.

In accordance with the invention, a method for preparing an aluminum-alloy article comprises the steps of providing an aluminum-alloy article that is not in its final heat-treated state and providing a curable organic coating material. The coating material has a non-volatile portion that is predominantly organic and curable at about a heat-treatment temperature of the aluminum-alloy article. The method further includes applying the organic coating material to the aluminum-alloy article by any suitable approach, and heat-treating the coated aluminum article to its final heat-treated state, thereby simultaneously curing the organic coating.

In the present approach, the article is preferably provided in an annealed or quenched condition suitable for the subsequent utilization of the strengthening heat-treatment, but not as yet heat-treated. The organic coating material, preferably dissolved in a suitable carrier liquid, is applied to the article which is not in its heat-treated state. The carrier liquid is removed by evaporation. The article is thereafter heat-treated to its full strength by heating to elevated temperature. During the heat-treatment according to the combination of temperature(s), time(s), and environment(s) specified for the aluminum-alloy base metal of the fastener, the coating is cured. Thus, no separate curing procedure is required after coating an already heat-treated article, which curing procedure would be likely to adversely affect the strength of the base metal of the article.

This approach yields surprising and unexpected technical and cost advantages when used in conjunction with high-strength aluminum fasteners such as rivets. The aluminum-alloy fasteners exhibit their full required strength produced by the heat-treatment used by itself. During installation, the fasteners need not be used in conjunction with wet sealants, wherein a viscous liquid sealant is applied to the fastener and faying surfaces just before upsetting the fastener. The elimination of the wet sealant installation approach for the over-700,000 rivets in a large cargo aircraft offers a cost savings of several million dollars per aircraft. The elimination of the use of wet sealants also improves the workmanship in the fastener installation, as there is no possibility of missing some of the fasteners as the wet sealant is applied. The coated fasteners are more resistant to corrosion during service than are uncoated fasteners.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
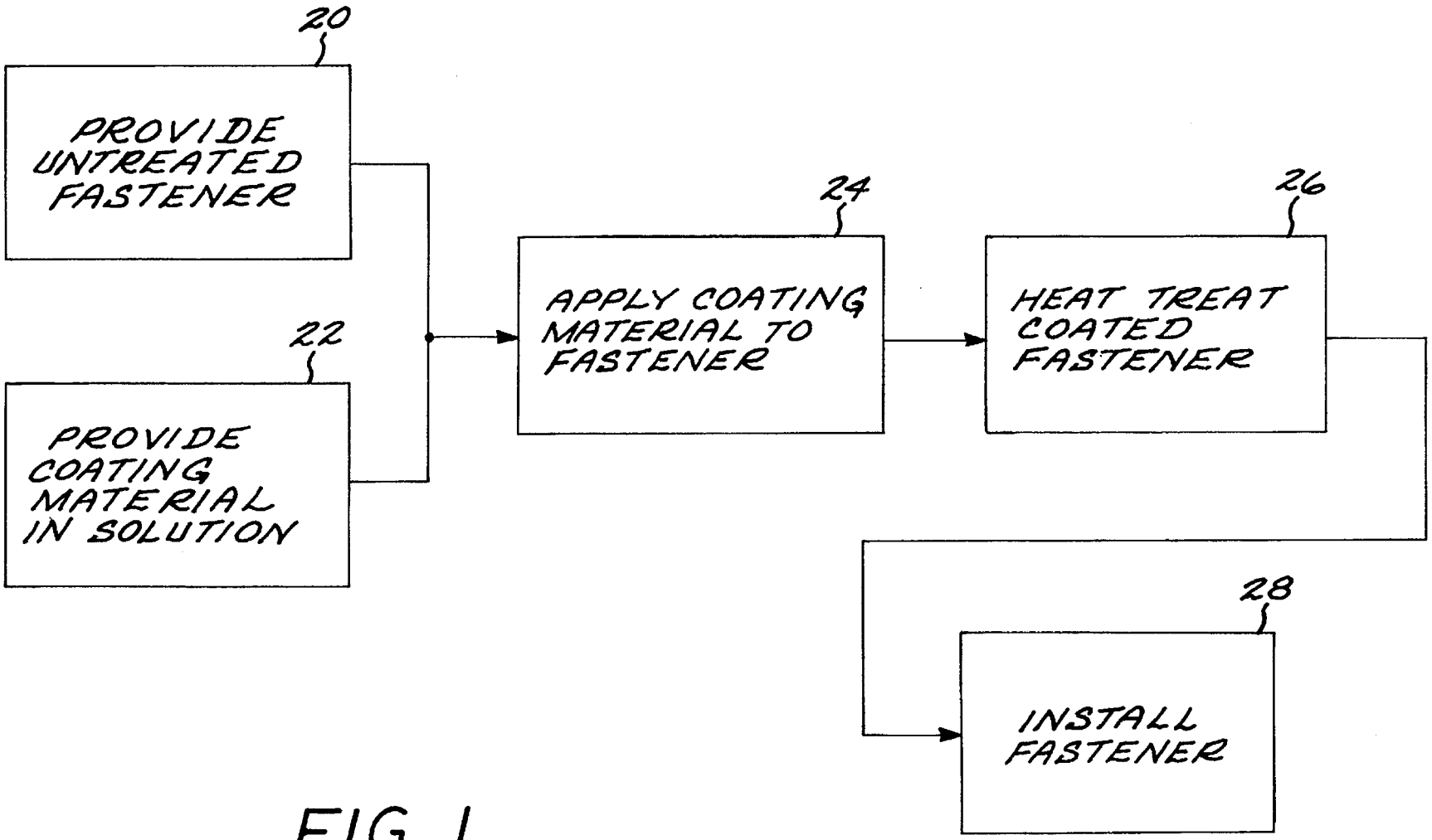
FIG. 1 is a process flow diagram for the method of the invention.

As depicted in FIG. 1, an untreated (i.e., uncoated and annealed) article is first provided. The preferred embodiment of the invention relates to the preparation of fasteners such as rivets, and the following discussion will emphasize such articles. The use of the invention is not limited to fasteners and rivets, and instead is more broadly applicable. However, its use in fasteners offers particular advantages that will be discussed.

Figure 2:
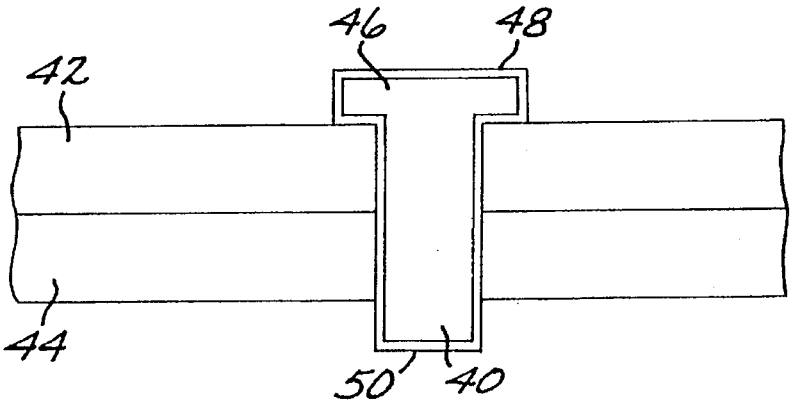
FIG. 2 is a schematic sectional view of a protruding-head rivet fastener used to join two pieces, prior to upsetting.
Figure 3:
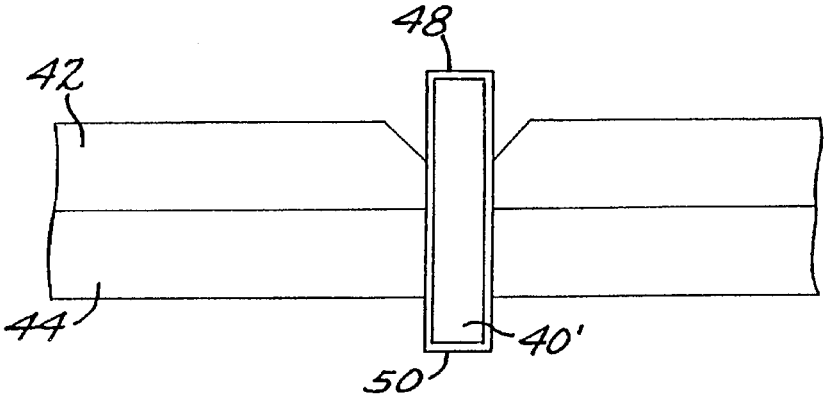
FIG. 3 is a schematic sectional view of a slug rivet fastener used to join two pieces, prior to upsetting.
Figure 4:
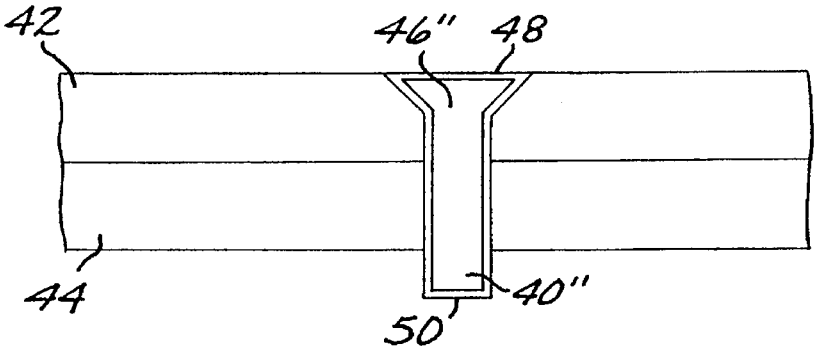
FIG. 4 is a schematic sectional view of a flush-head rivet fastener used to join two pieces, prior to upsetting.

A rivet 40 is provided, numeral 20. The present invention is used with a rivet, fastener, or other article manufactured to its conventional shape and size. FIGS. 2–4 illustrate three types of rivets 40, at an intermediate stage of their utilization to join a first piece 42 to a second piece 44, after installation to the first and second pieces before upsetting. The rivet 40 of but FIG. 2 has a premanufactured protruding head 46 on one end. The rivet 40' of FIG. 3, a slug rivet, has no preformed head on either end. The rivet 40" of FIG. 4 has a premanufactured flush head 46" on one end, that resides in a countersink in the piece 42.

The rivet 40 is manufactured of an aluminum-base alloy. As used herein, "aluminum-alloy" or "aluminum-base" means that the alloy has more than 50 weight percent aluminum but less than 100 weight percent aluminum. Typically, the aluminum-base alloy has about 85–98 weight percent of aluminum, with the balance alloying elements and a minor amount of impurity. Alloying elements are added in precisely controlled amounts to modify the properties of the aluminum alloy. Alloying elements that are added to aluminum in combination to modify its properties include, for example, magnesium, copper, and zinc, as well as other elements.

In the case of most interest, the aluminum alloy is heat-treatable. The alloying elements are selected such that the aluminum alloy can be processed to have a relatively soft state, as by annealing it at an elevated temperature for a period of time. The aluminum alloy in its soft state can be easily fabricated to form the rivet or other shape as shown in FIGS. 2–4. After the article is formed to its desired shape, it may be further processed to increase its strength several fold to have desired high-strength properties for service. The processing leading to strengthening is generally termed "heat-treating", wherein the article is subjected to one or more steps of exposure to an elevated temperature for a period of time, with heating and cooling rates selected to aid in producing the desired final properties. The temperatures, times, and other parameters required to achieve particular properties are known and are available in reference documents for standard aluminum-base alloys.

A specific aluminum-base alloy of most interest for rivet applications is an alloy which has a composition of about 2.3 weight percent copper, 2.2 weight percent magnesium, 6.2 weight percent zinc, 0.12 weight percent zirconium, balance aluminum plus minor impurities. (Other suitable alloys include, but are not limited to, 2000, 4000, 6000, and 7000 series heat-treatable aluminum alloys.) This alloy is available commercially from several aluminum companies, including ALCOA, Reynolds, and Kaiser. This alloy, designated 7050 alloy by the Aluminum Association, can be fully annealed (i.e., solution heat-treated) to have an ultimate shear strength of about 34,000–35,000 pounds per square inch (psi). (Aluminum Association terminology for alloy types, heat-treatments, and the like are accepted throughout the art, and will be used herein.) In this state, the fastener is machined or otherwise formed into the desired shape of an article, in this case the rivet 40 such as shown in FIGS. 2–4. This condition is termed the "untreated state" herein, as it precedes the heat-treatment required to increase the strength of the material. The article may be re-annealed after it is formed, prior to the strengthening heat-treatment.

After forming (and optionally re-annealing), the 7050 alloy may be heat-treated at a temperature of about 250° F. for 4–5 hours. The temperature is thereafter increased from 250° F. directly to about 355° F. for a period of 8–12 hours, followed by an ambient air cool. This state of heat-treatment, termed T73 condition, produces a strength of about 41,000–46,000 psi in the 7075 alloy, which is suitable for fastener applications.

A coating material is provided, numeral 22, preferably in solution so that it may be readily and evenly applied. The usual function of the coating material is to protect the base metal to which it is applied from corrosion, including, for example, conventional environmental corrosion, galvanic corrosion, and stress corrosion. The coating material is a formulation that is primarily of an organic composition, but which may contain additives to improve the properties. It is desirably initially dissolved in a carrier liquid so that it can be applied to a substrate. After application, the coating material is curable to effect structural changes within the organic component, typically cross linking of organic molecules to improve the adhesion and cohesion of the coating.

A wide variety of curable organic coating materials are available. A typical and preferred coating material of this type has phenolic resin mixed with one or more plasticizers, other organic components such as polytetrafluoroethylene, and inorganic additives such as aluminum powder and/or strontium chromate. These coating components are preferably dissolved in a suitable solvent present in an amount to produce a desired application consistency. For the coating material just discussed, the solvent is a mixture of ethanol, toluene, and methyl ethyl ketone. A typical sprayable coating solution has about 30 weight percent ethanol, about 7 weight percent toluene, and about 45 weight percent methyl ethyl ketone as the solvent; and about 2 weight percent strontium chromate, about 2 weight percent aluminum powder, balance phenolic resin and plasticizer as the coating material. A small amount of polytetrafluoroethylene may optionally be added. Such a product is available commercially as "Hi-Kote 1" from Hi-Shear Corporation, Torrance, Calif. It has an elevated temperature curing treatment of 1–4 hours at 350°–400° F., as recommended by the manufacturer.

The coating material is applied to the untreated fastener article, numeral 24. Any suitable approach, such as dipping, spraying, or brushing, can be used. In the preferred approach, the solution of coating material dissolved in solvent is sprayed onto the untreated rivets. The solvent is removed from the as-applied coating by drying, either at ambient or slightly elevated temperature, so that the coated article is dry to the touch. The coated article is not suitable for service at this point, because the coating is not sufficiently adhered to the aluminum alloy base metal and because the coating is not sufficiently coherent to resist mechanical damage in service.

In the case of the preferred Hi-Kote 1, the as-sprayed coating was analyzed by EDS analysis. The heavier elements were present in the following amounts by weight: Al, 82.4 percent; Cr, 2.9 percent; Fe, 0.1 percent; Zn, 0.7 percent; and Sr, 13.9 percent. The lighter elements such as carbon, oxygen, and hydrogen were detected in the coating but were not reported because the EDS analysis for such elements is not generally accurate.

The base metal of the rivet article and the applied coating are together heated to a suitable elevated temperature, numeral 26, to achieve two results simultaneously. In this s ingle step, the aluminum alloy is heat-treated to it s final desired strength state, and the coating s cured to its final desired bonded state. Preferably, the temperature and time treatment of step 26 is selected to be that required to achieve the desired properties of the aluminum alloy base metal, as provided in the industry-accepted and proven process standards for that particular aluminum-base alloy. This treatment may not produce the most optimal cure state for the coating, but it has been determined that the heat-treatment of the metal is less forgiving of slight variations from the optimal treatment than is the curing treatment of the organic coating. That is, the curing of the coating can sustain larger variations in time and temperature with acceptable results than can the heat-treatment of the metal. Thus, the use of the heat-treatment of the metal yields the optimal physical properties of the metal, and acceptable properties of the coating.

In the case of the preferred 7050 aluminum-base alloy and Hi-Kote 1 coating discussed above, the preferred heat-treating temperature is the T73 heat-treatment of 7050 alloy: 4–6 hours at 250° F., followed by a ramping up from 250° F. to 355° F. and maintaining the temperature at 355° F. for 8–12 hours, and an ambient air cool to ambient temperature.

Thus, the heat-treating procedure 26 involves longer times at temperature and higher temperatures than is recommended for the organic coating. There was initially a concern that the higher temperatures and longer times, beyond those required for curing the coating, would degrade the coating. This concern proved to be unfounded. The final coating 48, shown schematically in FIGS. 2–4, is strongly adherent to the base metal aluminum alloy and is also strongly internally coherent. (In FIGS. 2–4, the thickness of the coating 48 is exaggerated so that it is visible. In reality, the coating 48 is typically about 0.0003–0.0005 inches thick after treating in step 26.)

Figure 5:
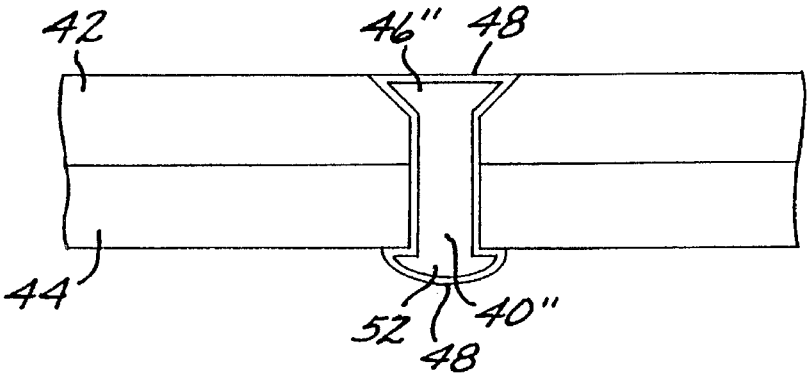
FIG. 5 is a schematic sectional view of the flush-head rivet fastener of FIG. 4, after upsetting.

The coated and treated rivet 40 is ready for installation, numeral 28. The fastener is installed in the manner appropriate to its type. In the case of the rivet 40, the rivet is placed through aligned bores in the two pieces 42 and 44, as shown in FIG. 2. The protruding remote end 50 of the rivet 40 is upset (plastically deformed) so that the pieces 42 and 44 are captured between the premanufactured head 46 and a formed head 52 of the rivet. FIG. 5 illustrates the upset rivet 40" for the case of the flush head rivet of FIG. 4, and the general form of the upset rivets of the other types is similar. The coating 48 is retained on the rivet even after upsetting, as shown in FIG. 5.

The installation step reflects one of the advantages of the present invention. If the coating were not applied to the fastener, it would be necessary to place a viscous wet sealant material into the bores and onto the faying surfaces as the rivet was upset, to coat the surfaces. The wet sealant material is messy and difficult to work with, and necessitates extensive cleanup of tools and the exposed surfaces of the pieces 42 and 44 with caustic chemical solutions after installation of the rivet. Moreover, it has been observed that the presence of residual wet sealant inhibits the adhesion of later-applied paint over the rivet heads. The present coating approach overcomes both of these problems. Wet sealant is not needed or used during installation. The later-applied paint adheres well over the coated rivet heads.

The present invention has been reduced to practice with rivets made of 7050 alloy. The rivets, initially in the untreated state, were coated with Hi-Kote 1 and another coating material, Alumazite ZY-138. (Alumazite ZY-138 is a sprayable coating available from Tiodize Co., Huntington Beach, Calif. Its composition includes 2-butanone solvent, organic resin, and aluminum powder.) The coated rivets were heat-treated to T73 condition with the heat-treatment of 4–6 hours at 250° F., followed by a ramping up from 250° F. to 355° F. and maintaining the temperature at 355° F. for 8–12 hours, followed by an ambient air cool.

The coated rivets were mechanically tested in accordance with MIL-R-5674 to verify that they meet required ultimate double shear strength requirements of 41,000–46,000 pounds per square inch achieved by uncoated rivets. In the testing, the ultimate double shear strength was 42,500–43,500 pounds per square inch, within the permitted range. Cylindrical lengths of each type of coated rivet were upset to a diameter 1.6 times their initial diameter to evaluate driveability. No cracking or spalling of the coating was noticed on the periphery of the upset specimens. Rivets were also installed and subsequently removed to evaluate coating integrity using a scanning electron microscope. The coatings exhibited no signs of cracking, spalling, or any other unacceptable conditions or abnormalities. This latter result is particularly important and surprising. The coatings were retained on the rivets even after upsetting. Thus, the coatings remained in place to protect the rivet after installation, obviating any need for the use of wet sealants.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing an aluminum-alloy article, comprising the steps of:

providing an aluminum-alloy fastener article in an untreated state, wherein the step of providing an aluminum-alloy article includes the step of providing a 7050 aluminum-alloy fastener;

providing a corrosion-resistant, curable organic coating material, the coating material comprising a phenolic resin and an organic solvent;

applying the organic coating material to the aluminum-alloy fastener article which is in the untreated state; and heating the coated aluminum article to a temperature sufficient to simultaneously heat-treat the aluminum-alloy fastener article and cure the organic coating, wherein the step of heating includes the step of heating the 7050 aluminum-alloy fastener to a temperature of about 250° F. for a time of from about 4 to about 6 hours, and thereafter heating the fastener to a temperature of about 355° F. for a time of from about 8 to about 12 hours.

2. The method of claim 1, wherein the step of providing an aluminum-alloy article includes the step of providing an aluminum-alloy article in its fully annealed state.

3. The method of claim 1, wherein the step of applying includes the step of spraying the organic coating material onto the aluminum-alloy article, and thereafter removing any volatile constituents from the sprayed coating.

4. The method of claim 1, including an additional step, after the step of heat-treating, of fastening a first piece to a second piece using the heat-treated article.

5. The method of claim 4, wherein the step of fastening includes the step of completing the fastening without using any wet sealant between the article and the pieces.

6. A method for preparing an aluminum-alloy article, comprising the steps of:

providing a 7050 aluminum-alloy rivet in an untreated state;

providing an organic coating material, the coating material having a non-volatile portion that is predominantly organic and requires curing prior to use;

applying the organic coating material to the aluminum-alloy rivet which is in an untreated state; and heating the coated aluminum rivet to a temperature of about 250° F. for a first period of time, and thereafter increasing the temperature to about 355° F. for a second period of time, the step of heating being operable to heat-treat the aluminum and cure the organic coating.

7. The method of claim 6, wherein the step of providing an organic coating material includes the step of providing the coating material comprising a phenolic resin and an organic solvent.

8. The method of claim 6, wherein the step of providing an aluminum-alloy rivet includes the step of providing the aluminum-alloy rivet in its fully annealed state.

9. The method of claim 6, wherein the step of applying includes the step of spraying the organic coating material onto the aluminum-alloy rivet, and thereafter removing any volatile constituents from the sprayed coating.

10. The method of claim 6, including an additional step, after the step of heat-treating, of fastening a first piece to a second piece using the heat-treated rivet.

11. The method of claim 10, wherein the step of fastening includes the step of completing the fastening without using any wet sealant between the rivet and the pieces.

* * * * *